US007063239B2

(12) United States Patent
Niada

(10) Patent No.: US 7,063,239 B2
(45) Date of Patent: Jun. 20, 2006

(54) DISPENSER FOR FOAMED DETERGENTS

(75) Inventor: Gianandrea Niada, Milan (IT)

(73) Assignee: QTS S.R.L., Caponage (IT)

( * ) Notice: Subject to any disclaimer, the term of this patent is extended or adjusted under 35 U.S.C. 154(b) by 185 days.

(21) Appl. No.: 10/874,816

(22) Filed: Jun. 23, 2004

(65) Prior Publication Data

US 2005/0017025 A1 Jan. 27, 2005

(30) Foreign Application Priority Data

Jun. 26, 2003 (EP) ..... 03425417

(51) Int. Cl.
*B67D 5/40* (2006.01)
*B67D 5/58* (2006.01)
*B67D 5/06* (2006.01)

(52) U.S. Cl. ..... 222/383.1; 222/190; 222/181.1; 222/181.3; 222/149; 239/106; 239/112

(58) Field of Classification Search ..... 222/190, 222/383.1, 180, 181.1, 181.3, 145.2, 148, 222/149, 145.1, 526; 239/112, 106, 104
See application file for complete search history.

(56) References Cited

U.S. PATENT DOCUMENTS 4,477,000 A * 10/1984 Arabian ..... 222/135
5,226,565 A * 7/1993 Hladis et al. ..... 222/148
5,779,104 A * 7/1998 Reidel ..... 222/190
5,862,954 A * 1/1999 Ehrensperger et al. ..... 222/190
5,906,299 A * 5/1999 Hagleitner ..... 222/190
6,082,586 A * 7/2000 Banks ..... 222/95
2003/0000967 A1 1/2003 Ehrensperger et al.

FOREIGN PATENT DOCUMENTS

CH 676227 A5 12/1978

* cited by examiner

*Primary Examiner*—Michael Mar
*Assistant Examiner*—Stephanie E. Tyler
(74) *Attorney, Agent, or Firm*—Lucas & Mercanti, LLP

(57) ABSTRACT

A dispenser for foamed detergents includes a cylinder (C) in which a piston (P) airtightly slides, the cylinder (C) being connected through a valve (V) to a foamer (F) where the detergent is mixed with air to form the foam which is dispensed through a dispensing chamber (U) provided with a nozzle (N), and further includes an additional piston (S) connected to the piston (P) through a shaft (A) and airtightly sliding in an additional cylinder (C") in communication with the outside through a one-way valve (Y), a duct (D) extending between said additional cylinder (C") and the dispensing chamber (U). In this way there is obtained the delivery of air through the duct (D) during the return travel to achieve the cleaning of the dispensing chamber (U) and of the dispensing nozzle (N) so as to prevent dripping of the foam and the development of mildew in case of a long interval before the next use.

5 Claims, 1 Drawing Sheet

DISPENSER FOR FOAMED DETERGENTS

This patent application claims the benefit of priority from European Patent Application No. 03425417.7 filed Jun. 26, 2003 the contents of which are incorporated herein by reference.

The present invention relates to apparatuses for dispensing liquid detergents, and in particular for foamed liquid soap.

It is known that in addition to conventional liquid detergent dispensers there are also dispensers which turn said liquid detergents into foam, since this form of the detergent has various advantages. In particular, foam spreads better on the surface to be washed and to achieve the same cleaning capacity there is required a smaller amount of detergent thanks to its greater surface area.

However dispensers for foamed detergents have a problem of cleaning of the dispensing chamber from which the foam is dispensed through a suitable nozzle. In fact, at the end of every operating cycle these parts must be cleaned of the remaining foam to prevent it from condensing and dripping and/or to prevent the development of mildew in case of a long interval until the next use.

A first type of known dispenser provides for the return travel of the dispensing piston to be used to draw in air from outside through the dispensing nozzle so as to suck the foam back inside. This arrangement does not assure the perfect cleaning of the dispensing chamber and may give rise to hygienic problems.

A second type of dispenser also uses the return travel of the piston, but in this case it is a double-effect piston that in the return travel dispenses air to clean the chamber. Such an arrangement is certainly more effective than the preceding one but requires a dispenser structure which is quite complicated and expensive.

Therefore the object of the present invention is to provide a dispenser which is free from said drawbacks. This object is achieved by means of a dispenser in which there is provided an additional chamber with its relevant piston to generate the cleaning jet. Other advantageous features of the present dispenser are disclosed in the dependent claims.

The advantage of the present dispenser is that of assuring a suitable cleaning through a simple and cheap structure, which results in greater reliability and ease of manufacturing.

Figure 1:
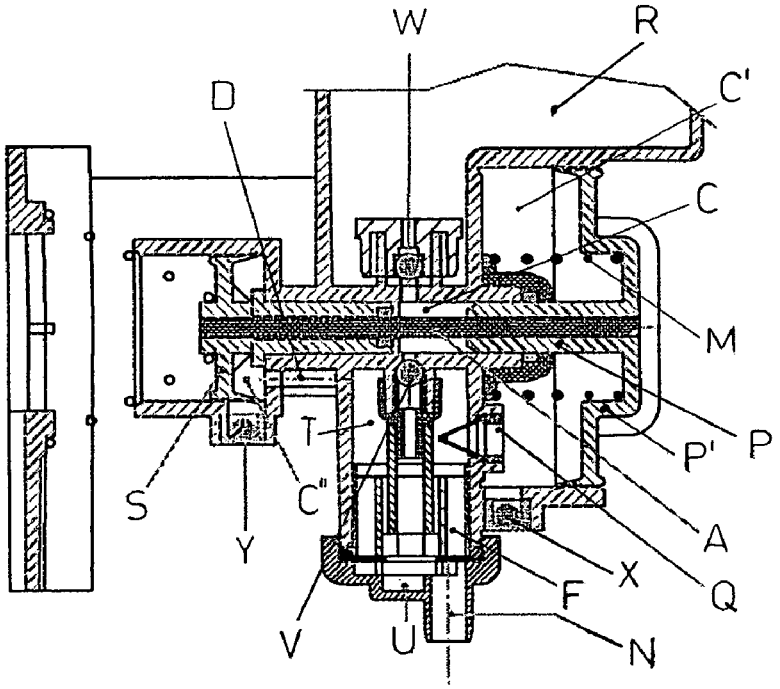
Figure 2:
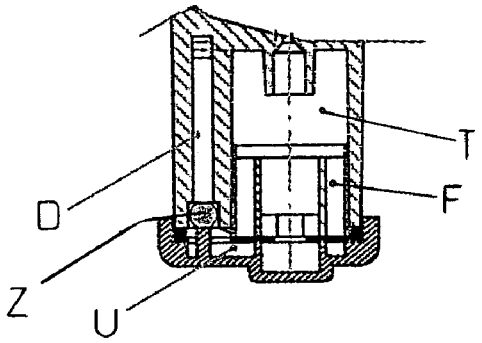

Further advantages and characteristics of the dispenser according to the present invention will be clear to those skilled in the art from the following detailed description of an embodiment thereof, with reference to the annexed drawings wherein:

FIG. 1 is a partial vertical sectional side view of the present dispenser; and FIG. 2 is a view similar to the preceding one but of the end portion of the dispenser only and with the section taken along a different plane.

With reference to said figures, there is seen that the present dispenser includes a reserve tank R, into which the detergent flows down by gravity from an overlying container (not shown), that is closed at the bottom by a one-way valve W. Through said valve, the liquid detergent enters a horizontal cylinder C in which a piston P airtightly slides. The detergent passes then through a ball valve V, calibrated by a spring, to a foamer F where it is mixed with air to form the foam which flows down into a dispensing chamber U from which it flows out through a nozzle N.

The air to form the foam comes from outside through a one-way valve X for the inflow into a cylinder C' which is in communication through a passage Q with a chamber T arranged between cylinder C and foamer F. The compression of the air in cylinder C' is carried out by a piston P' directly driven by the user and pushed outwards by a return spring M located inside cylinder C'.

The novel aspect of the present invention is the presence of a small additional piston S that airtightly slides in an additional cylinder C", arranged at the rear end of cylinder C, and is connected to piston P through a shaft A. Cylinder C" is in communication with the outside through a one-way valve Y for the inflow of air, similar to valve X, and a duct D starts from there and extends down to the dispensing chamber U.

It should be noted that the push of the user results in the driving of all three pistons P, P' and S in that they all make part of a single substantially T-shaped member which engages the main structural element of the dispenser. In other words, as shown in FIG. 1, tank R, cylinders C, C', C", duct D and chamber T are formed from a single element which also encloses foamer F and valves V, W, X and Y.

In the light of the description above, the operation of the present dispenser is readily understood.

When the user's push overcomes the resistance of spring M, piston P moves forward and the detergent contained in cylinder C can not flow back to tank R because of valve W, neither can it proceed to cylinder C", due to the additional piston S, whereby the pressure generated in cylinder C causes the opening of valve V and the downflow of the liquid detergent into foamer F.

Simultaneously, in cylinder C' the air is compressed by piston P' and passes to chamber T through passage Q then entering foamer F to form the foam. The thus formed foam flows down to chamber U and is dispensed through nozzle N. Always at the same time, also the additional piston S moves forward and air enters cylinder C" through valve Y.

When piston P starts the return travel under the push of spring M, the additional piston S compresses the air in cylinder C" and pushes it into duct D, since valve Y is closed. Therefore air is delivered to chamber U through duct D until the end of the return travel, and this causes the cleaning of chamber U and nozzle N so as to prevent dripping and mildew. In the meanwhile, the return of pistons P, P' causes a pressure drop in cylinders C, C' thus allowing the inflow of detergent and air through valves W, X respectively.

It should be noted that during the foam dispensing phase the foam cannot climb along duct D in that a one-way valve Z is provided to close the duct mouth.

It is clear that the above-described and illustrated embodiment of the dispenser according to the invention is just an example susceptible of various modifications. In particular, the shape, size and arrangement of the valves, pistons and passages may be somewhat changed according to specific manufacturing needs as long as in the return travel there is achieved the delivery of air to chamber U.

The invention claimed is:

1. Dispenser for foamed detergents, including a tank (R), a first cylinder (C) in which a first piston (P) airtightly slides for dispensing a liquid detergent introduced in said first cylinder (C) through a one-way valve (W), the first cylinder (C) being connected through a calibrated valve (V) to a foamer (F) where the detergent is mixed with air to form the foam which is dispensed through a dispensing chamber (U) provided with a nozzle (N), said air to form the foam being supplied from a second cylinder (C') in which a second piston (P') airtightly slides, characterized in that it further includes an additional third piston (S) connected to said first piston (P) through a shaft (A) and airtightly sliding in an additional third cylinder (C") in communication with the outside through a one-way valve (Y), a duct (D) extending between said third cylinder (C") and said dispensing chamber (U).

2. Dispenser for foamed detergents according to claim 1, characterized in that a one-way valve (Z) is arranged at the end of the duct (D) at the dispensing chamber (U).

3. Dispenser for foamed detergents according to claim 1, characterized in that the air to form the foam comes from outside through a one-way valve (X) for the inflow into the second cylinder (C') which is in communication through a passage (Q) with a chamber (T) arranged between the first cylinder (C) and the foamer (F), the compression of the air in the second cylinder (C') being carried out by a second piston (P') that is integral with the first piston (P).

4. Dispenser for foamed detergents according to claim 3, characterized in that the tank (R), the cylinders (C, C', C"), the duct (D) and the chamber (T) are formed from a single structural element which also encloses the foamer (F) and the valves (V, W, X, Y).

5. Dispenser for foamed detergents according to claim 1, characterized in that the calibrated valve (V) is a ball valve calibrated by a spring.

* * * * *